United States Patent [19]

Amano et al.

[11] Patent Number: 4,509,811

[45] Date of Patent: Apr. 9, 1985

[54] PRINTED-CIRCUIT BOARD CONNECTOR

[75] Inventors: Katutoshi Amano, Yokohama; Toshio Kakuta, Higashiosaka, both of Japan

[73] Assignees: Sony Corporation, Tokyo; Hosiden Electronic Co. Ltd., Osaka, both of Japan

[21] Appl. No.: 522,778

[22] Filed: Aug. 12, 1983

[30] Foreign Application Priority Data

Aug. 23, 1982 [JP] Japan ..... 57-127632[U]

[51] Int. Cl.[3] ..... H01R 23/70

[52] U.S. Cl. ..... 339/17 F; 339/17 LC; 339/75 MP; 339/176 MP

[58] Field of Search ..... 339/17 L, 17 LC, 17 F, 339/75 MP, 176 M, 176 MP, 176 MF

[56] References Cited

U.S. PATENT DOCUMENTS 3,084,302 4/1963 Braeutigam ..... 339/17 F
3,689,865 9/1972 Pierini et al. ..... 339/176 MP
4,410,230 10/1983 SanMiguel ..... 339/176 M

FOREIGN PATENT DOCUMENTS 54092 6/1982 European Pat. Off. ..... 339/17 LC

*Primary Examiner*—Neil Abrams
*Attorney, Agent, or Firm*—Pollock, Vande Sande and Priddy

[57] ABSTRACT

A second body half formed by a substantially rectangular metal plate is assembled with a substantially rectangular parallelepipedic first body half fabricated of a synthetic resinous material to form a connector proper, with a printed-circuit sheet insertion opening defined therebetween for receiving a mating printed-circuit sheet. In the printed-circuit sheet insertion opening, the first body half has formed therein side by side in its lengthwise direction contact member receiving grooves extending in the direction in which a printed-circuit sheet is inserted into the printed-circuit sheet opening. Contact members are mounted in the contact member receiving grooves, the contact members being fixedly held by the first body half.

17 Claims, 17 Drawing Figures

PRINTED-CIRCUIT BOARD CONNECTOR

BACKGROUND OF THE INVENTION

The present invention relates to a printed-circuit board multi-connector, and more particularly to a printed-circuit board multi-connector for use with a flexible printed-circuit sheet.

A conventional printed-circuit board connector is entirely formed of a synthetic resinous material and its miniaturization inevitably leads to the reduction of the thickness of its body. When inserting a mating connector, i.e. a printed-circuit sheet connector into a printed-circuit sheet insertion opening of the connector, contact pieces in the connector are resiliently pressed into contact with contact members of the mating connector to provide good electrical connection. But the reaction forces resulting from the resilient displacement of the contact pieces act to widen the printed-circuit sheet insertion opening. Accordingly, when the connector body is thin, the printed-circuit sheet insertion opening is widened by the reaction forces of the contact pieces, resulting in insufficient contact between the contact pieces and the contacts of the mating printed-circuit sheet.

Further, according to the prior art, the connector body having the printed-circuit insertion opening and contact receiving portions communicating with the insertion opening is formed as a molding of a synthetic resinous material and individual contact pieces are mounted in the contact receiving portions. Such a structure imposes limitations on the reduction of the width of each of the contact pieces and the pitch of their arrangement when the connector is miniaturized.

Moreover, in the case of the conventional connector having its body formed only of the synthetic resinous material, its miniaturization encounters difficulty in obtaining a sufficient lock mechanism for stably holding the inserted mating printed-circuit sheet, introducing the possibility of the printed-circuit sheet readily coming off the connector.

In order to facilitate easy insertion of the multi-connector of the conventional flexible printed-circuit sheet commonly referred to as the flat cable into the insertion opening of the connector and to ensure good contact between them, it is considered to attach a reinforcing member to the end portion of the flexible printed-circuit sheet to be inserted and to insert the reinforced end portion of the printed-circuit sheet into the insertion opening of the connector. In the prior art, however, the reinforcing member merely mechanically hardens the end portion of the flexible printed-circuit sheet.

SUMMARY OF THE INVENTION

It is therefore an object of the present invention to provide a printed-circuit board connector which is small but mechanically strong and hard to deform and provides a sufficient contact pressure.

Another object of the present invention is to provide a printed-circuit board connector which can be stably held on a mounting board regardless of the direction in which a printed-circuit sheet is inserted into an insertion opening of the connector.

According to the present invention, a first body half of a synthetic resinous material and a second body half formed by a metal plate are assembled into a connector proper to define therebetween an insertion opening for receiving a mating printed-circuit sheet. Contact pieces are held on the first body half and their contact portions are positioned in the insertion opening. The intermediate portions of the contact pieces are buried in the first body half to extend in the direction of insertion of the printed-circuit sheet into the insertion opening. Those portions of the contact pieces projecting out from the first body half on the side of insertion of the printed-circuit sheet are folded back and positioned in the insertion opening to form contact members, and the other projecting end portions are used as terminals. A holding piece, which extends from the intermediate portion of the rear marginal edge of the second body half, is bent substantially at right angles towards the first body half and is further folded back forwardly to press the first body half, preventing it from bending.

The terminals are arranged along one marginal edge (a corner portion) of the back of the connector proper to project out therefrom. First and second fixing pieces, which are formed integrally with the second body half to extend therefrom, are projected out from the connector body near its marginal portions of both end walls of the connector proper distant from the terminals. When the connector proper is mounted on a mounting board, the terminals are connected to circuit patterns on the mounting board and, at the same time, one of the first and second fixing pieces is fixed to the mounting board to stably hold the connector proper thereto regardless of whether the printed-circuit sheet is inserted into the connector at right angles or in parallel to the mounting board.

The end portion of the mating flexible printed-circuit sheet to be inserted into the insertion opening of the connector has fixed thereto a reinforcing member extending in its widthwise direction. A hook-shaped engaging piece is formed integrally with the reinforcing member to project from the intermediate portion thereof, and a notch is formed in the front of the first body half for receiving the hook-shaped engaging piece. When the reinforcing member is inserted into the connector insertion opening, the hook-shaped engaging piece is engaged with the notch to prevent the first body half from bending. Further, by the engagement of the hook-shaped engaging piece and the notch, the contact members of the connector and the contact members of the printed-circuit sheet are positioned to make contact with each other. Moreover, a recess is formed in one of the opposing surfaces of the reinforcing member and the second body half and a projection is formed in the other for engagement with the recess to stably hold the reinforcing member in the insertion opening.

DESCRIPTION OF THE PREFERRED EMBODIMENTS

Figure 1:
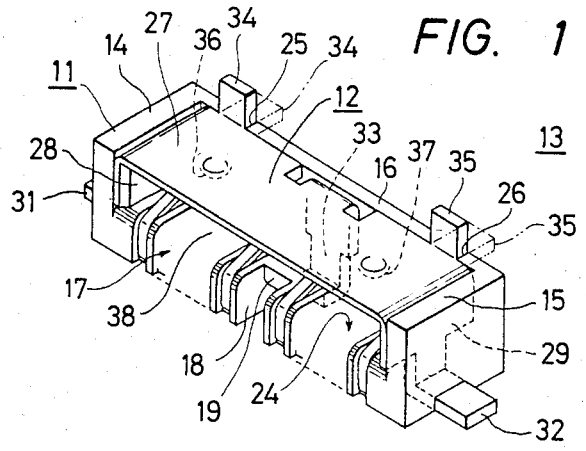
FIG. 1 is a perspective view illustrating an example of the printed-circuit board connector of the present invention.
Figure 2:
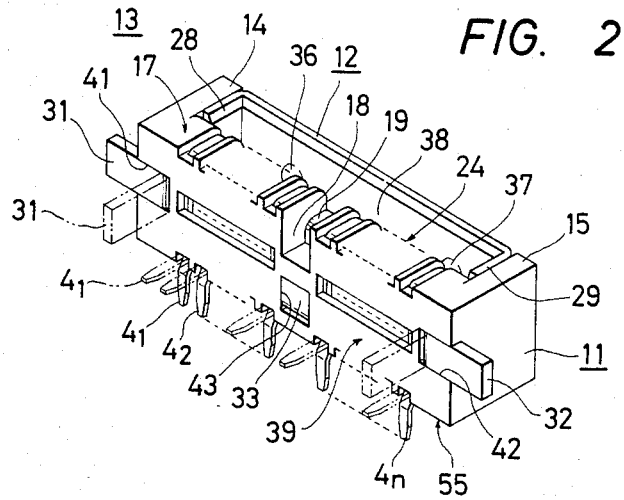
FIG. 2 is a perspective view of the printed-circuit connector, with its bottom on the front.
Figure 3:
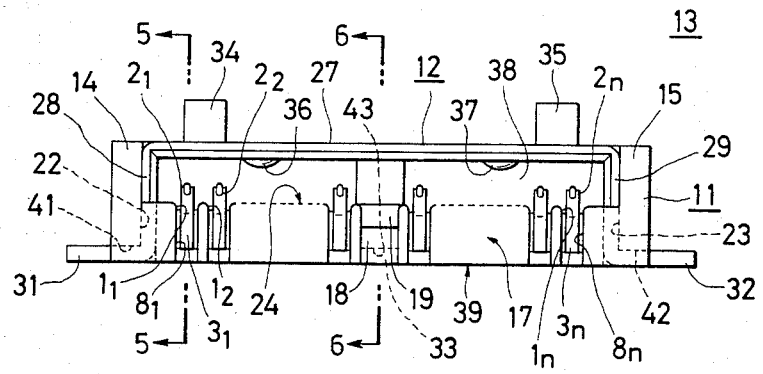
FIG. 3 is a plan view of FIG. 2, with its top on the front.
Figure 4:
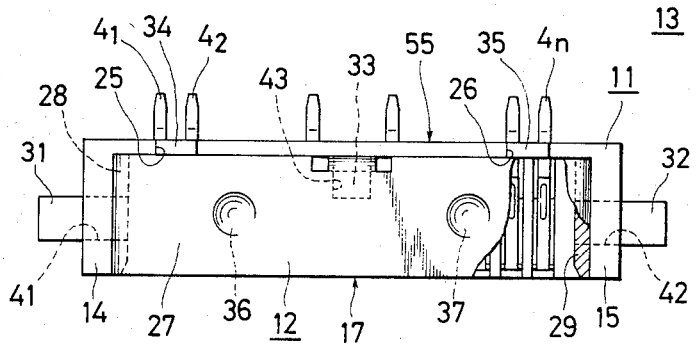
FIG. 4 is a plan view of FIG. 3.
Figure 5:
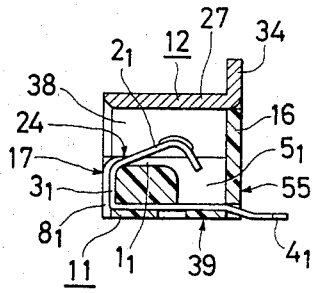
FIG. 5 is a cross-sectional view taken on the line 5—5 in FIG. 3.
Figure 6:
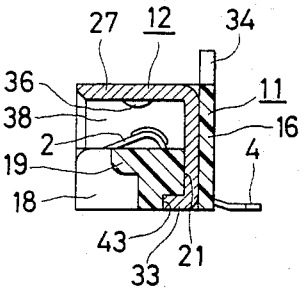
FIG. 6 is a cross-sectional view taken on the line 6—6 in FIG. 3.
Figure 7:
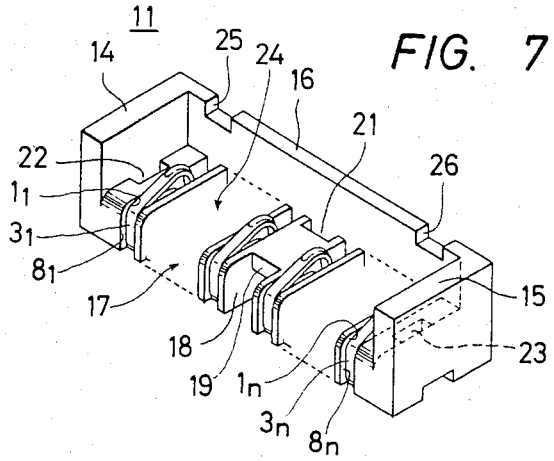
FIG. 7 is a perspective view of a first body half 11.

FIGS. 1 through 6 illustrate an embodiment of the printed-circuit board connector of the present invention. A first body half 11, which is a molding of a synthetic resinous material, and a second body half 12, which is formed by a metal plate, are assembled into a connector 13. As shown in FIG. 7, the first body half 11 takes the form of a substantially rectangular parallelepiped, and has a pair of opposing side walls 14 and 15 extending from its both end portions and a rear wall 16 extending between the side walls 14 and 15 along its one marginal edge in its lengthwise direction. A notch 18 is formed in the face 17 of the first body half 11 (which face will hereinafter be referred to as the front face) substantially at the center thereof on the opposite side from the rear wall 16. The notch 18 is partly formed shallow on the side on which the rear wall 16 projects out of the first body half 11, providing an engaging portion 19 as shown in FIGS. 3 and 6. A slot 21 is made in the first body half 11 to extend along the interior surface of the rear wall 16 in opposing relation to the notch 18. Similarly, slots 22 and 23 are made in the first body half 11 inside the side walls 14 and 15 to extend along them, respectively.

The interior surface 24 of the first body half 11 defined by the walls 14, 15 and 16 has formed therein contact member receiving grooves $1_1$, $1_2$, . . . $1_n$ which extend widthwise of the first body half 11 and are arranged lengthwise thereof as illustrated in FIGS. 3 and 7. In the contact member receiving grooves $1_1$ to $1_n$ are disposed contact members $2_1$ to $2_n$, respectively. The contact members $2_1$ to $2_n$ are mounted on the first body half 11 in the following manner: As shown in FIG. 5 in which the contact member $2_1$ is depicted, the intermediate portion of a contact piece $3_1$ made of a resilient metal material is molded in the first body half 11 along the bottom face 39 thereof so that the contact piece $2_1$ extends widthwise thereof (in the lengthwise direction of the contact member receiving groove $1_1$) and projects out from both the front face 17 and the rear face 55 thereof. The portion of the contact piece $3_1$ projecting out from the front face 17 of the first body half 11 is folded back to extend along the peripheral surface of the first body half 11, forming the contact member $2_1$. The other end portion of the contact piece $3_1$ projecting out from the rear face 55 of the first body half 11 (on the side of the rear wall 16) is used as a terminal $4_1$. As depicted in FIG. 5, the contact member receiving grooves $1_1$ to $1_n$ are formed deep on the side of the rear wall 16 to provide relieves $5_1$ to $5_n$ ($5_n$ being not shown). The bottom surfaces of the contact member receiving grooves $1_1$ to $1_n$ are used as bending dies for bending the contact members $2_1$ to $2_n$. In the front face 17 of the first body half 11 are formed grooves $8_1$ to $8_n$ contiguous to the contact member receiving grooves $1_1$ to $1_n$, respectively. Incidentally, recesses 25 and 26 are formed in both end portions of the side wall 16 as shown in FIG. 7.

Figure 8:
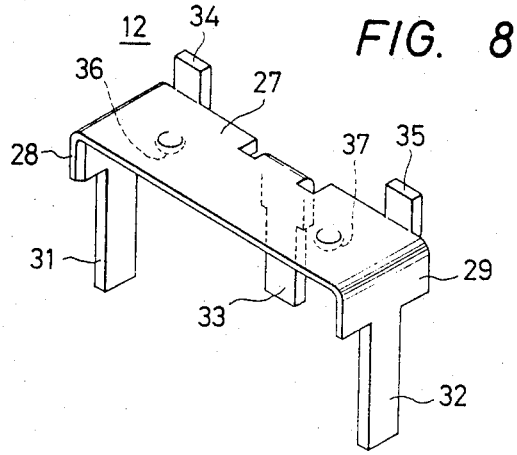
FIG. 8 is a perspective view of a second body half 12.

The second body half 12 is made by press work of a metal plate. As illustrrated in FIG. 8, a rectangular plate member 27 is bent at both ends at right angles in the same direction to form bent pieces 28 and 29, from the end portions of which narrow fixing pieces 31 and 32 are extended at a displaced position from the center thereof. The central portion of one marginal portion of the plate member 27 is bent at right angles to extend in the same direction as the fixing pieces 31 and 32 to form a holding piece 33. Both end portions of the marginal portion of the plate member 27, from which the holding piece 33 extends, are bent at right angles to extend in the direction opposite from the holding piece 33, forming fixing lugs 34 and 35. A pair of downward protrusions 36 and 37 are formed by press in the plate member 27 centrally thereof in the widthwise direction thereof and arranged in the lengthwise direction of the plate member 27.

As shown in FIGS. 1 to 4, the fixing pieces 31 and 32 of the second body half 12 are fitted into the slots 22 and 23 of the first body half 11; the holding piece 33 of the second body half 12 is fitted into the slot 21 of the first body half 11; the fixing lugs 34 and 35 of the second body half 12 are rested on the recesses 25 and 26 of the first body half 11; the end portions of the fixing pieces 31 and 32 projecting out from the slots 22 and 23 are bent outwardly at right angles; and the end portion of the holding piece 33 projecting out from the slot 21 is folded back in opposing relation to the plate member 27 as shown in FIG. 6. In this case, the projecting ends of the bent pieces 28 and 29 abut against the interior surface 24 of the first body half 11 and the plate member 27, that is, the second body half 12 is held between the side walls 14 and 15 of the first body half 11. Between the interior surface 24 of the first body half 11 and the plate member 27 of the second body half 12 is defined an opening 38 for receiving a printed-circuit sheet connector. In the bottom face 39 of the first body half 11 on the opposite side from its interior surface 24 are formed recesses 41, 42 and 43 for receiving the fixing pieces 31 and 32 and the holding piece 33 so that when they are bent they may be flush with the bottom face 39 of the first body half 11 as shown in FIG. 2.

Figure 9:
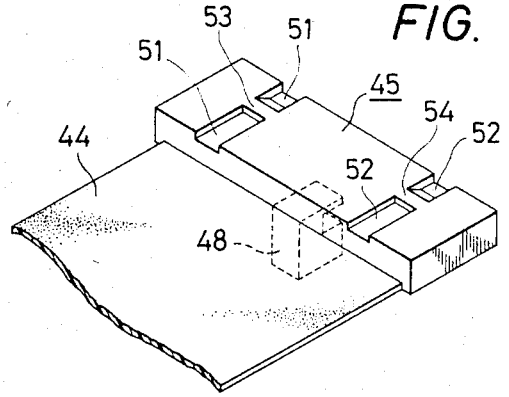
FIG. 9 is a perspective view showing examples of a printed-circuit sheet to be inserted into a printed-circuit sheet insertion opening of the connector and a reinforcing member.
Figure 10:
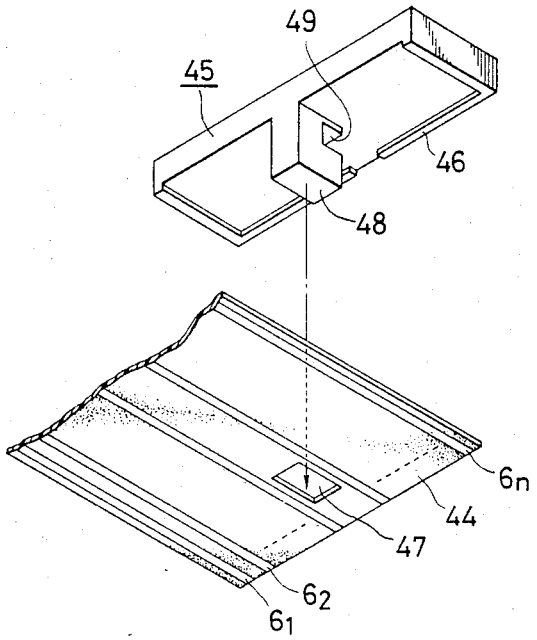
FIG. 10 is an exploded perspective view of FIG. 9.

A printed-circuit sheet 44 (FIG. 9) that is to be inserted into the connector insertion opening 38 may constitute, for instance, a flexible cable. One end portion of the flexible printed-circuit sheet 44 has deposited on one surface thereof conductor patterns $6_1$, $6_2$ . . . $6_n$ extending in parallel in its lengthwise direction and arranged side by side in its widthwise direction as shown in FIG. 10. A reinforcing member 45 is fixedly mounted on the abovesaid end portion of the printed-circuit sheet 44 to extend in the widthwise direction thereof. The reinforcing member 45 is a thin, rectangular molding of a synthetic resinous material, one side of which has an edge flange 46 raised about its periphery except one marginal edge in its lengthwise direction. The printed-circuit sheet 44 and the reinforcing member 45 are fixed to each other by an adhesive or double adhesive tape with the marginal edge of the end portion of the printed-circuit sheet 44 abutting against the inside of the edge flange 46 and with the surface opposite from the surface having the printed-circuit thereon being held in contact with the reinforcing member 45.

This example shows the case where the reinforcing member 45 not only permits easy insertion of the printed-circuit sheet (connector) into the connector insertion opening 38 but also reinforces the connector body 13. To this end, a hole 47 is made in the end portion of the printed-circuit sheet 44 centrally thereof and a hook-shaped engaging piece 48 for engagement with the hole 47 is formed integrally with the reinforcing member 45 to project out therefrom in the same direction of the edge flange 46 at the central portion on the marginal edge opposite therefrom. The hook-shaped engaging piece 48 has formed therein a notch 49 on the side of the marginal edge of the printed-circuit sheet 44. The size of the reinforcing member 45 is selected so that it may be snugly fitted into the connector insertion opening 38.

The reinforcing member 45 has locking means which, when it is inserted into the connector insertion opening 38, cooperates with the protrusions 36 and 37 of the second body half 12 to stably hold the printed-circuit sheet 44 to the connector 13. For example, in the surface of the reinforcing piece 45 on the opposite side from the surface on which the printed-circuit sheet 44 is mounted, there are cut a pair of guide grooves 51 and 52 which extend in the widthwise direction of the reinforcing piece 45 from its one marginal edge on the side of the marginal edge of the printed-circuit sheet 44. Engaging projections 53 and 54 are formed in the intermediate portions of the guide grooves 51 and 52. The engaging projections 53 and 54 and the guide grooves 51 and 52 constitute engaging recesses 51 and 52. Those portions of the engaging projections 53 and 54 on the side of the marginal edge of the printed-circuit sheet 44 are tapered i.e., inclined.

When the printed-circuit sheet 44 having fixedly mounted thereon is inserted into the connector insertion opening 38 of the connector proper 13, the conductor patterns $6_1$ to $6_n$ make contact with the contact members $2_1$ to $2_n$, respectively. In this state, the hook-shaped engaging piece 48 is fitted into the notch 18 of the first body half 11 and the engaging portion 19 is engaged with the notch 49 of the hook-shaped engaging piece 48. Further, when insserting the reinforcing member 45 into the insertion opening 38, the engaging projections 53 and 54 of the reinforcing member 45 respectively slide over the protrusions 36 and 37 of the second body half 12 into engagement therewith, stably holding the printed-circuit sheet 44 in the insertion opening 38 so that the conductor patterns $6_1$ to $6_n$ may make good contact with the contact members $2_1$ to $2_n$. The conductor patterns $6_1$ to $6_n$ of the printed-circuit sheet 44 resiliently make contact with the contact members $2_1$ to $2_n$, respectively, to ensure their electric interconnections. In this case, the contact members $2_1$ to $2_n$ are resiliently displaced towards the bottoms of the contact member receiving grooves $1_1$ to $1_n$ and the end portions of the contact members $2_1$ to $2_n$ are positioned in the relieves $5_1$ to $5_n$, respectively.

When the printed-circuit sheet 44 is held in the printed-circuit sheet insertion opening 38, the contact members $2_1$ to $2_n$ are resiliently displaced and their reaction forces act to enlarge the width of the insertion opening 38 but, in the present invention, since the second body half 12 is formed by a metal plate, the connector proper 13 is mechanically reinforced and the conductor patterns $6_1$ to $6_n$ are urged against the contact members $2_1$ to $2_n$ with sufficient contact pressures. In particular, according to the structure of the present invention in which the contact pieces $3_1$ to $3_n$ are buried, i.e., embedded in the molding of the first body half 11 and folded back at one end to form the contact members $2_1$ to $2_n$, the bottom surfaces of the contact member receiving grooves $1_1$ to $1_n$ can be raised close to the inner surfaces of the contact members $2_1$ to $2_n$, so that the thickness of the first body half 11 can be increased to withstand the reaction forces of the contact members $2_1$ to $2_n$. Further, since the holding piece 33 is folded back to hold the intermediate portion of the first body half 11 as in the foregoing example, it is possible to prevent the first body half 11 from being bent by the aforesaid reaction forces of the contact members $2_1$ to $2_n$. When the number of the contact members $2_1$ to $2_n$ is large and, as a result, the connector proper 13 is long, a plurality of such holding pieces 33 can be provided in the lengthwise direction of the connector proper 13 to thereby increase the mechanical strength of the connector proper 13. Moreover, in the foregoing example, since the hook-shaped engaging piece 48 is engaged with the engaging portion 19 of the notch 18 to couple the reinforcing member 45 and the first body half 11 at the intermediate portion lengthwise thereof, it is possible to prevent bending of the first body half 11 by the reaction forces of the contact members $2_1$ to $2_n$ and to achieve reliable contact between the conductor patterns $6_1$ to $6_n$ of the printed-circuit sheet 44 and the contact members $2_1$ to $2_n$. It is also possible to provide pluralities of such hook-shaped engaging pieces 48, and a plurality of corresponding notches 18 and engaging portions 19. Besides, the second body half 12 is formed by a metal plate, and hence can be formed thinner than in the case where it is made of a synthetic resinous material and it is free from deformation by external heating. Accordingly, the connector proper 13 is not likely to be deformed by an ambient temperature change and the printed-circuit sheet 44, when inserted into the insertion opening 38, can be stably held in position.

In the case where the connector 13 is formed small and thin as a whole through using a synthetic resinous material as in the prior art, it is difficult to provide a lock mechanism for holding the printed-circuit sheet in the connector insertion opening. According to the foregoing embodiment of the present invention, since the second body half 12 is formed by a metal plate, the protrusions 36 and 37 can easily be formed and the engaging projections 53 and 54 (engaging recesses 51 and 52) of the reinforcing member 45 and, accordingly, the lock mechanism can easily be obtained. In addition, when inserting the printed-circuit sheet 44 into the connector insertion opening 38, the engaging projections 53 and 54 can readily slide over the protrusions 36 and 37 owing to the guide grooves 51 and 52 and the inclined faces of the engaging projections 53 and 54. Further, by making it easy to fit the hookshaped engaging piece 48 into the notch 18 of the first body half 11, the printed-circuit sheet 44, when inserted into the connector insertion opening 38, can be positioned relative to the connector proper 13 and, consequently, the contact members $2_1$ to $2_n$ and the conductor patterns $6_1$ to $6_n$ can be brought into opposing relation to each other with accuracy. Accordingly, the pitch of the contact members $2_1$ to $2_n$ and the width of each contact member can be reduced, permitting miniaturization of the connector proper 13 in its entirety. Incidentally, positioning of the reinforcing member 45 relative to the printed-circuit sheet 44 is performed by the edge flange 46 and the hook-shaped engaging piece 48 of the reinforcing member 45 and the marginal edge of the end portion of the printed-circuit sheet 44 and its opening 47.

Figure 11:
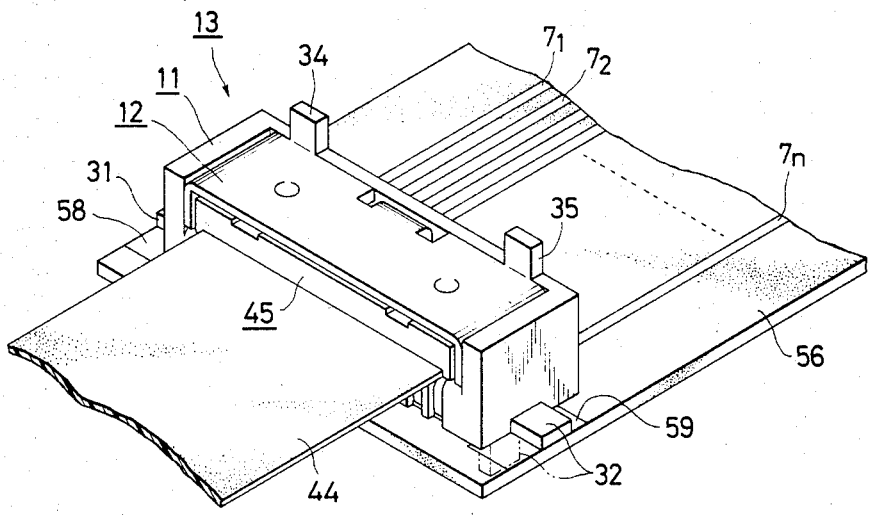
FIG. 11 is a perspective view illustrating an example of the state in which the printed-circuit board connector of the present invention is mounted on a mounting board.
Figure 12:
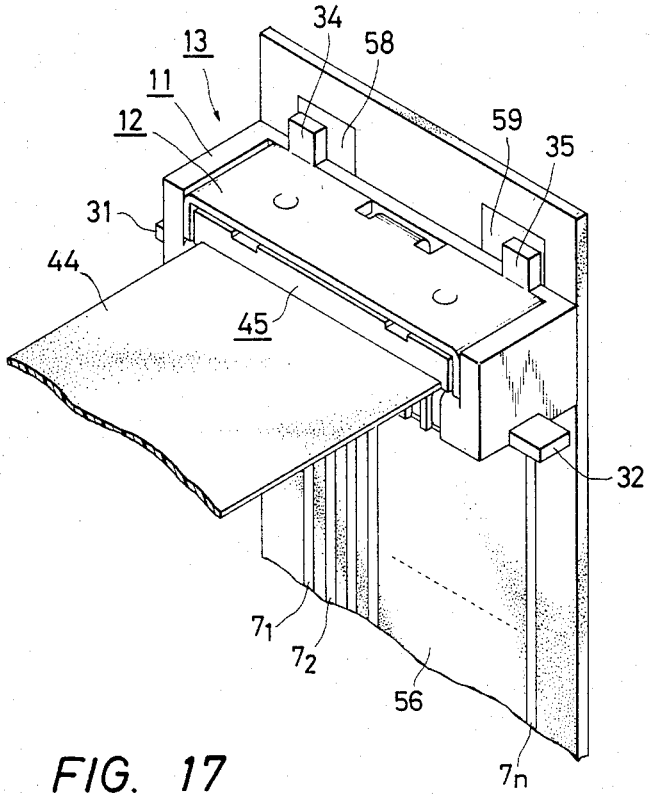
FIG. 12 is a perspective view showing another example of the state in which the printed-circuit board connector of the present invention is mounted on a mounting board.
Figure 13:
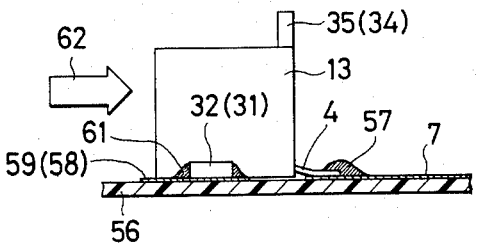
FIG. 13 is a side view of FIG. 11.

According to the present invention, the connector proper 13 can be mounted on a printed-circuit board 56 so that the printed-circuit sheet 44 is inserted into and pulled out of the connector insertion opening 38 in parallel to the surface of the printed-circuit board 56, for instance, as shown in FIG. 11. Alternatively, the connector proper 13 can be mounted on the printed-circuit board 56 so that the direction of insertion of the printed-circuit sheet 44 may be perpendicular to the surface of the printed-circuit board 56 as shown in FIG. 12. The printed-circuit board 56 has deposited thereon circuit patterns $7_1$ to $7_n$. The connector proper 13 is mounted on the top surface of the printed-circuit board 56 on which the circuit patterns $7_1$ to $7_n$ are formed, or on the underside of the printed-circuit board 56. In the example shown in FIGS. 1 to 6, when the printed-circuit sheet 44 is inserted into the opening 38 of the connector proper 13 in parallel to the printed-circuit board 56, terminals $4_1$ to $4_n$ (FIGS. 2 and 4) extending in parallel to the direction of insertion of the printed-circuit sheet 44 are soldered to the circuit patterns $7_1$ to $7_n$ on the printed-circuit board 56 as indicated by 57 and the fixing pieces 31 and 32 of the second body half 12 are soldered to fixing patterns 58 and 59 (FIG. 11) formed on the printed-circuit board 56 as indicated by 61 in FIGS. 11 and 13. The arrow 62 in FIG. 13 indicates the direction of insertion of the printed-circuit sheet 44 into the insertion opening 38 of the connector proper 13. If the fixing pieces 31 and 32 are not fixed to the fixing patterns 58 and 59, when the printed-circuit sheet 44 is inserted into the connector 13, the sheet receiving side of the connector 13 is pushed up from the printed-circuit board 56 to introduce the possibility of bad contact between the terminals $4_1$ to $4_n$ and the circuit patterns $7_1$ to $7_n$. With the structure of FIG. 13, however, the fixing pieces 31 and 32 stably hold the connector proper 13 to the printed-circuit board 56 regardless of the insertion thereinto of the printed-circuit sheet 44.

Figure 14:
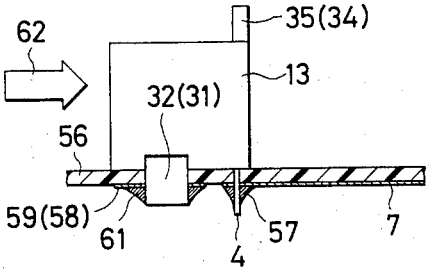
FIG. 14 is a side view showing an example of the state in which the printed-circuit board connector of the present invention is mounted on a mounting board in the case where the printed-circuit sheet is inserted into the connector in parallel to the mounting board and circuit patterns are formed on the underside of the mounting board.

In the case where the printed-circuit sheet 44 is inserted into the connector proper 13 in parallel to the printed-circuit board 56 and the circuit patterns $7_1$ to $7_n$ are deposited on the underside of the board 56, the terminals $4_1$ to $4_n$ are formed as indicated by the broken lines in FIG. 2 to project out on the underside of the board 56 through small holes made therein and the projecting ends are soldered to the circuit patterns $7_1$ to $7_n$, respectively, as indicated by 57 in FIG. 14. Further, the fixing pieces 31 and 32 are bent to project out onto the underside of the board 56 through slits made therein as indicated by the broken lines in FIG. 2 and the projecting ends are connected by soldering to the fixing patterns 58 and 59, respectively, as indicated by 61. Also in this case, the fixing pieces 31 and 32 fixed to the fixing patterns 58 and 59 stably hold the connector proper 13 to the board 56 against the force for inserting the printed-circuit sheet 44 into the connector proper 13 or pulling out the former from the latter.

Figure 15:
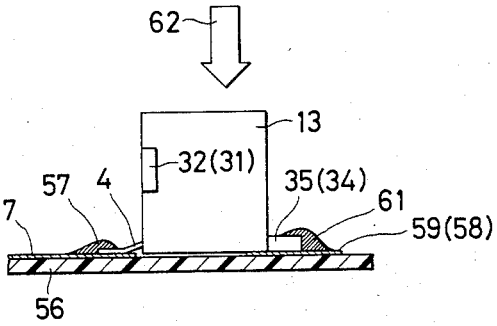
FIG. 15 is a side view of FIG. 12.
Figure 16:
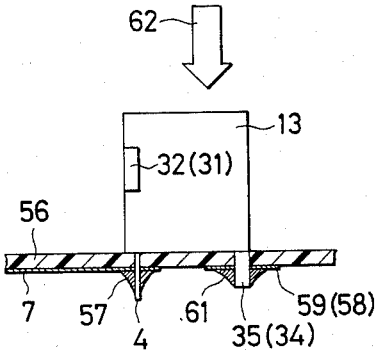
FIG. 16 is a side view showing the state in which the printed-circuit board connector of the present invention is mounted on a mounting board in the case where the printed-circuit sheet is inserted into the connector at right angles to the mounting board and the circuit patterns are formed on the underside of the mounting board.

In the case where the printed-circuit sheet 44 is inserted into the connector proper 13 in the direction perpendicular to the board 56 and the circuit patterns $7_1$ to $7_n$ are formed on that portion of the board 56 on the side of the connector proper 13, the terminals $4_1$ to $4_n$ are soldered to the circuit patterns $7_1$ to $7_n$ as indicated by the broken lines in FIG. 2 and the fixing lugs 34 and 35 are soldered to the fixing patterns 58 and 59 as indicated by 61 as shown in FIGS. 12 and 15. Also in this case, by fixing of the fixing lugs 34 and 35 to the fixing patterns 58 and 59, the terminals $4_1$ to $4_n$ are fixed and the connector proper 13 is stably held to the printed-circuit board 56 against the force of inserting or pulling out the printed-circuit sheet 44. Moreover, in the case where the printed-circuit sheet 44 is inserted into the connector proper 13 in the direction perpendicular to the printed-circuit board 56 and the circuit patterns $7_1$ to $7_n$ are deposited on the underside thereof, the terminals $4_1$ to $4_n$ are formed to project out onto the underside of the board 56 and connected to the circuit patterns $7_1$ to $7_n$ as shown in FIG. 16 and the fixing lugs 34 and 35 are bent as indicated by the broken lines in FIG. 2 and inserted into the board 56 and soldered to the fixing patterns 58 and 59. In this way, the connector proper 13 can be stably held to the printed-circuit board 56 against the force of inserting or pulling out the printed-circuit sheet 44.

Figure 17:
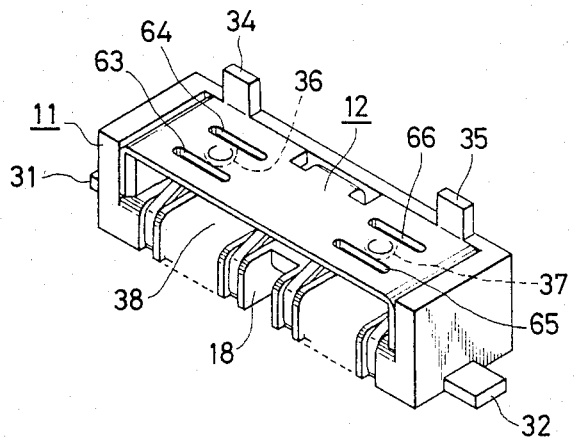
FIG. 17 is a perspective view illustrating another example of the printed-circuit board connector of the present invention.

While in the foregoing the protrusions 36 and 37 are engaged with the engaging recesses 51 and 52 for stably holding the printed-circuit sheet 44 in the insertion opening 38, it is also possible to form slits 63, 64, 65 and 66 in the second body half 12 to extend in its lengthwise direction on both sides of the protrusions 36 and 37 as shown in FIG. 17, thereby providing the protrusions 36 and 37 with resiliency to facilitate their engagement with the engaging recesses 51 and 52.

It will be apparent that many modifications and variations may be effected without departing from the scope of the novel concepts of the present invention.

What is claimed is:

1. A printed-circuit board connector comprising:

a substantially rectangular elongated parallelepiped first body fabricated of a synthetic resinous material, said first body having contact receiving grooves formed in one of the rectangular faces thereof, said contact receiving grooves extending in the width direction of said first body and being arranged side by side to one another in the lengthwise direction of said first body, said first body also having first and second insertion slots formed in the opposing end portions thereof parallel to said grooves and in spaced relation thereto;

a second body comprising an elongated substantially rectangular metal plate having first and second integral leg portions extending at right angles to the plane of said plate at the opposing narrower ends of said plate, said second body further including first and second fixing pieces having widths narrower than the widths of said first and second leg portions and extending integrally from said first and second leg portions in parallel relation to one another and in directions perpendicular to the plane of said metal plate, said first and second fixing pieces being inserted into one end of said first and second insertion slots, respectively, from the side of said first body on which said contact receiving grooves are formed, said first and second fixing pieces extending completely through said insertion slots so that the free end portions of said first and second fixing pieces project out of the other ends of said first and second insertion slots, said free end portions of said first and second fixing pieces being deformed to fixedly attach said first and second bodies to one another to form a connector body having first and second elongated rectangular faces, first and second side faces connecting said first and second elongated rectangular faces at both ends thereof, and front and rear faces, all of which faces are defined respectively by the outer surfaces of said first and second bodies, said metal plate of said second body being spaced by said leg portions from the face of said first body having said contact receiving grooves to define an insertion opening in said connector body that is located between said first and second bodies for receiving therein a printed-circuit sheet; and a plurality of contact members having intermediate portions which are embedded in said first body to extend in a direction parallel to the direction of insertion of the printed-circuit sheet into said insertion opening, one end portions of said contact members projecting outwardly from said front face of said connector body and being folded back into said contact receiving grooves to form contacts, and the other end portions of said contact members projecting outwardly from said rear face of said connector body for use as terminals.

2. A printed-circuit board connector according to claim 1 wherein a third fixing piece extends from an intermediate portion of the rear longer side of said second body at right angles thereto into a third insertion slot formed in a marginal portion of said first body along the rear longer side thereof, said third fixing piece having a free end portion which projects out of said third insertion slot and which is bent toward said front face of the connector body to urge said first and second bodies against each other.

3. A printed-circuit board connector comprising:

a substantially rectangular elongated parallelepiped first body fabricated of a synthetic resinous material, said first body having contact receiving grooves formed in one of the rectangular faces thereof, said contact receiving grooves extending in the width direction of said first body and being arranged side by side to one another in the lengthwise direction of said first body, said first body also having first and second insertion slots formed in the opposing end portions thereof parallel to and spaced from said grooves and a third insertion slot formed in a marginal portion of said first body between said first and second slots and along one of the elongated sides of said first body;

a second body comprising an elongated substantially rectangular metal plate having first and second integral leg portions extending at right angles to the plane of said plate at the opposing narrower ends of said plate, said second body further including first and second fixing pieces having widths narrower that the widths of said first and second leg portions and extending integrally from said first and second leg portions in directions perpendicular to the plane of said metal plate and a third fixing piece formed integrally with said plate along one of the elongated side thereof, said first, second and third fixing pieces being inserted into said first, second and third insertion slots, respectively, from the face of said first body on which said contact receiving grooves are formed, at least said third fixing piece extending through its associated insertion slot and having a free end portion which projects outwardly from said insertion slot and which is bent to fixedly attach said first and second bodies to one another to form a connector body having first and second elongated rectangular faces, first and second side faces connecting said first and second elongated rectangular faces at both ends thereof, and front and rear faces, all of which faces are defined respectively by the outer surfaces of said first and second borders, said metal plate of said second body being spaced by said leg portions from the face of said first body having said contact receiving grooves to define an insertion opening that is located between said first and second bodies for receiving therein a printed-circuit sheet; and a plurality of contact members having intermediate portions which are embedded in said first body to extend in a direction parallel to the direction of insertion of the printed-circuit sheet into said insertion opening, one end portions of said contact members projecting outwardly from said front face of said connector body and being folded back into said contact receiving grooves to form contacts and the other end portions of said contact members projecting outwardly from said rear face of said connector body for use as terminals.

4. A printed-circuit board connector according to claim 1 or 3 wherein the printed-circuit sheet is a flexible printed-circuit sheet, and a reinforcing member of a synthetic resinous material fixed to the end portion of the flexible printed-circuit sheet to be inserted into the insertion opening, said reinforcing member being of such a size that it snugly fits into said insertion opening.

5. A printed-circuit board connector according to claim 4 wherein a hook-shaped engaging piece is formed integrally with said reinforcing member to extend from the intermediate portion of its contact surface with the printed-circuit sheet, a notch being formed in the intermediate portion of the front face of the first body for engagement with the hook-shaped engaging piece, and the hook-shaped engaging piece being engaged with the notch from the outside of the first body to prevent said intermediate portion thereof from bending outwardly.

6. A printed-circuit board connector according to claim 5, wherein an edge flange is raised about the periphery of the contact surface of the reinforcing member with the printed-circuit sheet for contact with the peripheral margin of the end portion of the printed-circuit sheet, and an opening being formed in the printed-circuit sheet through which the hook-shaped engaging piece extends, the end portion of the printed-circuit sheet being positioned by the hook-shaped engaging piece and the edge flange relative to the reinforcing member.

7. A printed-circuit board connector according to claim 4, wherein the second body has formed therein protrusions arranged in its lengthwise direction and projecting out into the printed-circuit sheet insertion opening, and wherein the surface of the reinforcing member on the opposite side from the printed-circuit sheet has formed therein engaging recesses for engagement with the protrusions when the reinforcing member is completely inserted into the printed-circuit sheet insertion opening.

8. A printed-circuit board connector according to claim 7, wherein the surface of the reinforcing member on the opposite side from the printed-circuit sheet has formed therein guide grooves extending in its widthwise direction from the marginal edge of the end portion of the reinforcing member to be inserted into the printed-circuit sheet insertion opening, and wherein engaging projections are formed integrally with the intermediate portions of the guide grooves, the engaging projections and the guide grooves constituting the engaging recesses and the surfaces of the engaging projections on the opposite side from the engaging recesses being tapered.

9. A printed-circuit board conector according to claim 7, wherein the second body has formed therein a pair of slits extending in its lengthwise direction on both sides of each protrusion.

10. A printed-circuit board connector according to claims 1 or 3 wherein said second body includes at least one lug that is formed integrally therewith to extend from the rear longer side of said second body, said first and second fixing pieces being for use in mounting said connector body on a printed-circuit board in a first position with said first elongated face directly opposing said board and said lug being for use in mounting said connector body on a printed-circuit board in a second position with said rear face directly opposing said board.

11. A printed-circuit board connector according to claim 1 or 3, wherein said side walls are formed integrally with both end portions of said first body to extend along the outer surfaces of said leg portions of said second body.

12. A printed-circuit board connector according to claim 10 wherein said terminals extend in the direction of insertion of the printed-circuit sheet into said insertion opening and wherein said first and second fixing pieces are bent flush with said first elongated face to project out from both the first and second side faces of said connector body.

13. A printed-circuit board connector according to claim 10 wherein said terminals extend in a direction perpendicular to the direction of insertion of the printed-circuit sheet into said insertion opening and wherein said first and second fixing pieces extend in the same direction as the direction of the terminals.

14. A printed-circuit board connector according to claim 10 wherein said terminals extend at right angles to the direction of insertion of the printed-circuit sheet into said insertion opening and wherein said lug projects perpendicularly to said second elongated face of said connector body in substantially the same plane as the plane of said terminals but in a direction opposite to said terminals.

15. A printed-circuit board connector according to claim 10 wherein said terminals extend in the direction of insertion of the printed-circuit sheet into said insertion opening, and wherein said lug extends in the same direction as the terminals.

16. A printed-circuit board connector according to claim 11, wherein the first body has formed integrally therewith a rear wall extending between the rear ends of said side walls.

17. A printed-circuit board connector comprising:

a substantially rectangular elongated parallelepiped first body half made of a synthetic resinous material and having formed in one of the rectangular faces thereof contact receiving grooves extending in its width direction and arranged side by side in its lengthwise direction, said first body half having first and second insertion slots formed in both end portions thereof parallel to and spaced from said grooves;

a second body half comprising an elongated substantially rectangular metal plate having first and second integral leg portions spaced from one another and extending at right angles to the plane of said plate, said first and second leg portions including first fixing means comprising first and second fixing pieces which extend from said leg portions and which are inserted through said first and second insertion slots to assemble said first and second body halves into a connector body having first and second elongated rectangular faces, first and second side faces connecting said first and second elongated rectangular faces at both ends thereof, and front and rear faces, all of which faces are defined respectively by the outer surfaces of said first and second body halves, said metal plate of said second body half being spaced by said leg portions from the face of said first body half having said contact receiving grooves to define an insertion opening that is located between said first and second body halves for receiving therein a printed-circuit sheet, said second body half further including second fixing means comprising at least one lug formed integrally therewith to extend from the rear longer side thereof; and a plurality of contact members having intermediate portions which are embedded in said first body half to extend in parallel to the direction of insertion of the printed-circuit sheet into said insertion opening, one end portions of said contact members projecting outwardly from said front face of said first body half and being folded back into said contact receiving grooves to form contacts, and the other end portions of said contact members projecting outwardly from said rear face of said first body half for use as terminals;

said first fixing means being for mounting said connector body on a printed-circuit board in a first position with said first elongated face directly opposing said board, and said second fixing means being for mounting said connector body on a printed-circuit board in a second position with said rear face directly opposing said board.

* * * * *